US007484286B2

(12) United States Patent
Fowler

(10) Patent No.: US 7,484,286 B2
(45) Date of Patent: Feb. 3, 2009

(54) GARAGE DOOR HAVING REMOVABLE VENT OR GLASS COVERS

(76) Inventor: Darrell Fowler, 6666 Stuart Ave., Jacksonville, FL (US) 32254

( * ) Notice: Subject to any disclaimer, the term of this patent is extended or adjusted under 35 U.S.C. 154(b) by 726 days.

(21) Appl. No.: 11/166,971

(22) Filed: Jun. 24, 2005

(65) Prior Publication Data

US 2006/0289127 A1 Dec. 28, 2006

(51) Int. Cl.

| | |
|---|---|
| ***A47H 1/00*** | (2006.01) |
| ***B21K 21/16*** | (2006.01) |
| ***E05D 15/00*** | (2006.01) |
| ***E05D 15/38*** | (2006.01) |
| ***E06B 3/48*** | (2006.01) |

(52) U.S. Cl. ..... 29/401.1; 29/897.1; 49/197; 160/104; 160/113; 160/201

(58) Field of Classification Search ..... 29/401.1, 29/897, 897.3; 49/168, 197; 52/208, 209.65; 160/89, 104, 113, 189, 201, 215, 229.1, 238
See application file for complete search history.

(56) References Cited

U.S. PATENT DOCUMENTS

| | | | | |
|---|---|---|---|---|
| 587,983 | A | 8/1897 | Martin | |
| 843,139 | A * | 2/1907 | Feldman | 160/89 |
| 1,289,753 | A | 12/1918 | Haydon | |
| 2,758,646 | A | 8/1956 | Johnson | |
| 3,178,776 | A | 4/1965 | Stansberry | |
| 3,861,081 | A | 1/1975 | Maskell | |
| 3,927,709 | A * | 12/1975 | Anderson et al. | 160/37 |
| 4,760,872 | A | 8/1988 | Hale, Jr. | |
| 4,770,087 | A | 9/1988 | Danley et al. | |
| 5,497,588 | A * | 3/1996 | Martin et al. | 52/208 |
| 5,603,190 | A | 2/1997 | Sanford | |
| 5,906,070 | A | 5/1999 | Boerhave | |
| 5,946,856 | A | 9/1999 | Davlantes | |
| 5,976,009 | A | 11/1999 | Achen | |
| 2003/0221803 | A1 * | 12/2003 | Forsland | 160/229.1 |
| 2004/0250967 | A1 | 12/2004 | Dorest | |

* cited by examiner

*Primary Examiner*—David P Bryant
*Assistant Examiner*—Alexander P Taousakis
(74) *Attorney, Agent, or Firm*—Thomas C. Saitta

(57) ABSTRACT

A removable cover for a garage door vent or window, and preferably a cover for vents and windows in a garage door having embossed raised decorative panels incorporated into the door sections for decorative and aesthetic purposes, wherein the cover is slidingly received within a generally U-shaped in cross-section track externally mounted about the perimeter of the vent/window opening. Most preferably, the cover is formed of the rectangular piece of material removed from the garage door section to create the vent/window opening, such that with the cover in place over the vent/window, the decorative pattern and overall look of the door is virtually identical to the look of a door that is not provided with vents or windows. For garage doors having embossed raised decorative panels, the relatively large planar interior face portion of the raised panel having inwardly sloping sides is preferably removed to form the cover.

11 Claims, 4 Drawing Sheets

GARAGE DOOR HAVING REMOVABLE VENT OR GLASS COVERS

BACKGROUND OF THE INVENTION

This invention relates generally to the field of garage doors, and more particularly to the field of garage doors having raised or embossed decorative panels, wherein the doors are provided with vents, windows or the like such that air, water and light may pass through the door as desired or required. More particularly, the invention relates to such doors wherein covers or closures for the vents and windows are provided.

Overhead garage doors comprised of multiple inter-connected, horizontally elongated sections that are raised and lowered on tracks are well known. The vast majority of such garage doors have the sections made of sheet metal or the like, and the sections are usually mounted on vertical stiles and horizontal struts or braces. It is also very common for such doors to have raised or embossed rectangular panels provided as decorative features to improve the aesthetics of the doors, the panels being formed by stamping, pressing or similar metal working techniques.

In many circumstances it is desirable or even required by building regulations to provide the garage door with windows or vents. The windows allow natural light to enter the garage when the door is closed. The vents, which are typically covered with a screen, mesh or other apertured material, allow air to pass through the door to better control the interior temperature of the garage or allow floodwater to pass through the door in flood conditions. Such vents are often required by building codes.

It is often desirable to provide a means to cover, conceal or otherwise close the windows or vents such that light, air or water cannot pass through. Examples of garage door structures that incorporate vent or window covers include U.S. Pat. No. 3,178,776 to Stansberry, showing a cover affixed to the door by mechanical clips, U.S. Pat. No. 4,770,087 to Danley et al., showing a hinged cover mounted on the exterior of the door that pivots to open the vent, and U.S. Pat. No. 5,976,009 to Achen, showing a vent having a sliding panel that is retained by brackets mounted on the interior of the door. The covers shown in these patents require complicated mounting mechanisms or are not aesthetically pleasing.

It is an object of this invention to provide a vent cover or window cover for a garage door that is mounted to the door section with a relatively simple mechanism and which allows the cover to be easily and quickly installed or removed to cover the vent or window. It is a further object to provide such a cover that is aesthetically complementary to the garage door, such that with the covers in place the garage door has the appearance of a non-vented or non-windowed door. It is a further object to provide such a cover structure, wherein the cover itself comprises the sheet metal material removed from the door section to create the vent or window opening, such that the material cut from the door section is not wasted, such that additional material is not required to manufacture the cover, and such that overall visual pattern of the door is matched exactly when the cover is in place over the vent or window. These objects, as well as additional objects not expressly referenced herein, will become apparent upon further review of the disclosure to follow.

SUMMARY OF THE INVENTION

The invention comprises in general a removable cover for a garage door vent or window, and preferably a cover for vents and windows in a garage door having embossed raised decorative panels incorporated into the door sections for decorative and aesthetic purposes, wherein the cover is slidingly received within a generally U-shaped in cross-section track externally mounted about the perimeter of the vent/window opening. Most preferably, the cover is formed of the rectangular piece of material removed from the garage door section to create the vent/window opening, such that with the cover in place over the vent/window, the decorative pattern and overall look of the door is virtually identical to the look of a door that is not provided with vents or windows. For garage doors having embossed raised decorative panels, the relatively large planar interior face portion of the raised panel having inwardly sloping sides is preferably removed to form the cover.

DETAILED DESCRIPTION OF THE INVENTION

With reference to the drawings, the invention will now be described with regard for the best mode and the preferred embodiment. In a broad and general sense, the invention is a garage door with vents or windows and removable covers for the vents or windows, wherein the cover is slidingly retained by a track mounted to the exterior of the door. Most preferably, the cover is comprises the material blank removed from the garage door to form the window or vent opening.

Figure 1:
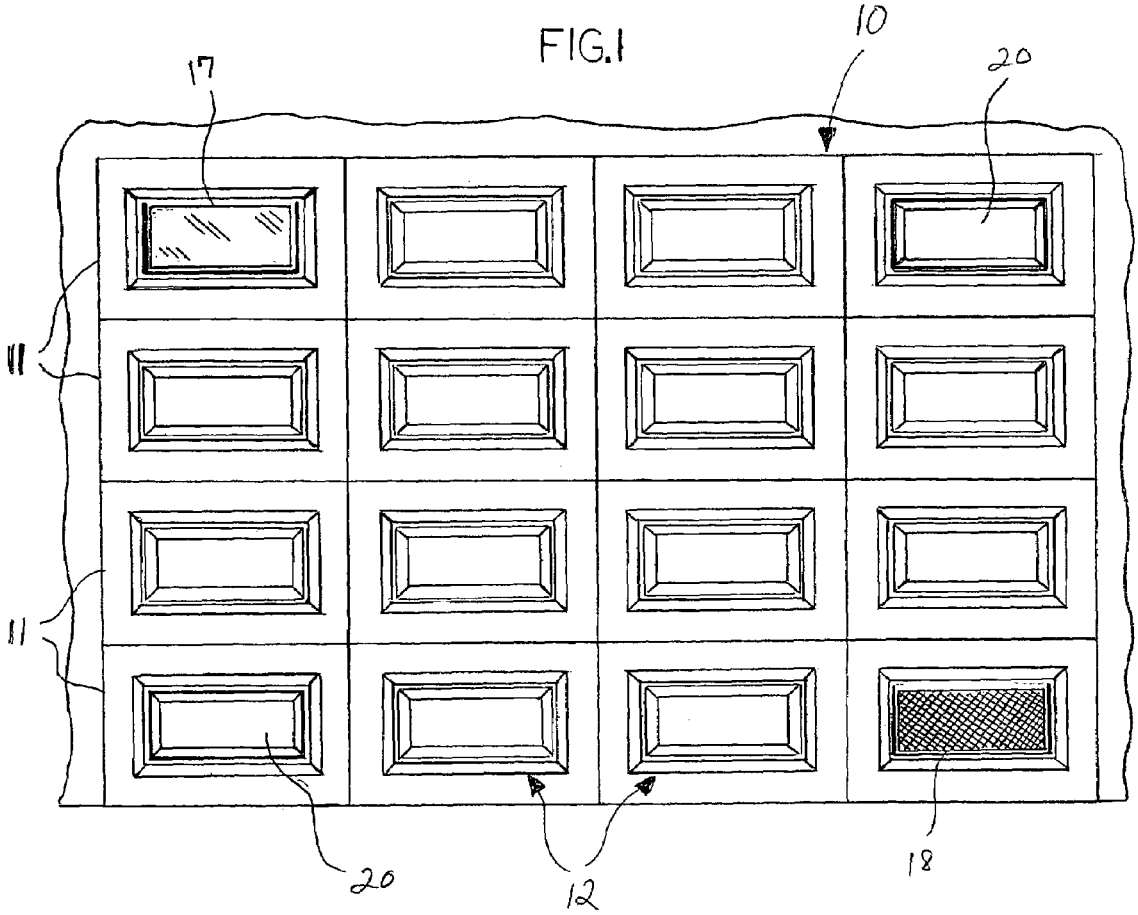
FIG. 1 is a front exterior view of a representative overhead garage door having four horizontal sections with embossed raised decorative panels, illustrating an uncovered window, a covered window, an uncovered vent and a covered vent.
Figure 2:
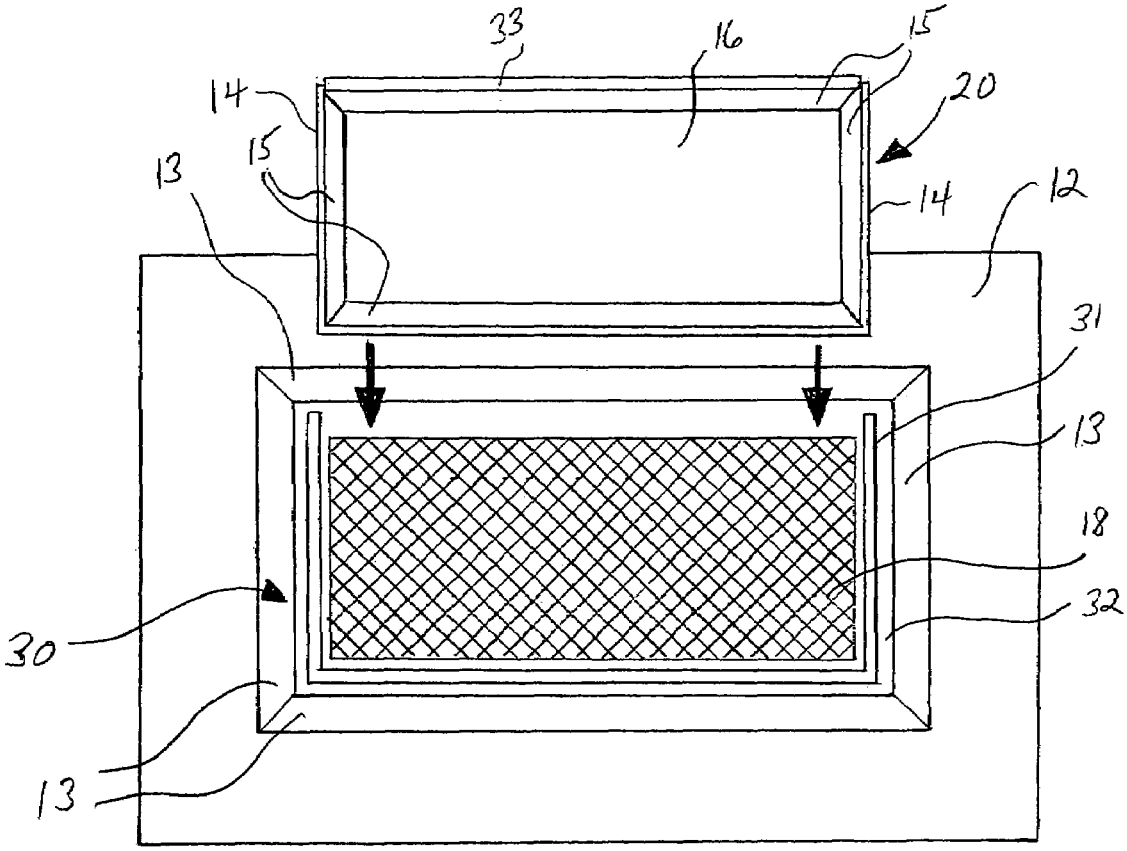
FIG. 2 is a front exterior view of a vent and the cover prior to positioning the cover to close the vent.

FIG. 1 illustrates a representative and typical garage door 10 of the overhead type, wherein the garage door 10 is comprised of multiple elongated, rectangular, horizontal sections 11 that are retained by interiorly positioned stiles and struts in well known manner that allows the door 10 to be raised and lowered on tracks disposed within the garage itself. The door sections 11 are typically composed of sheet metal or other material of similar thickness and material properties. In the preferred embodiment as shown, the garage door 10 is provided with embossed raised decorative panels 12. The embossed raised panels 12 may be formed in many different configurations and are not limited to the configuration shown in the drawings, which is for illustrative purposes, wherein the embossed raised panels 12 are formed by creating a recessed channel or trough having a sloped outer wall 13, a flat bottom 14, a sloped inner wall 15 and a generally planar, relatively large face 16.

Disposed on the garage door 10 are windows 17, located in the outermost panels 12 of the uppermost section 11 of FIG. 1, and vents 18, located in the outermost panels 12 of the lowest section 11, positioned in generally rectangular cutouts or openings 19. As shown in FIG. 1, the left-side window 17 is uncovered and the right-side window 17 is closed by a cover 20, and the right-side vent 18 is uncovered and the left-side vent 18 is closed by a cover 20. The vents 18 may be composed of suitable material that provides apertures to allow passage of air or water, such as through the use of intersecting wires or strips, screen or mesh material, expanded metal or the like.

Figure 3:
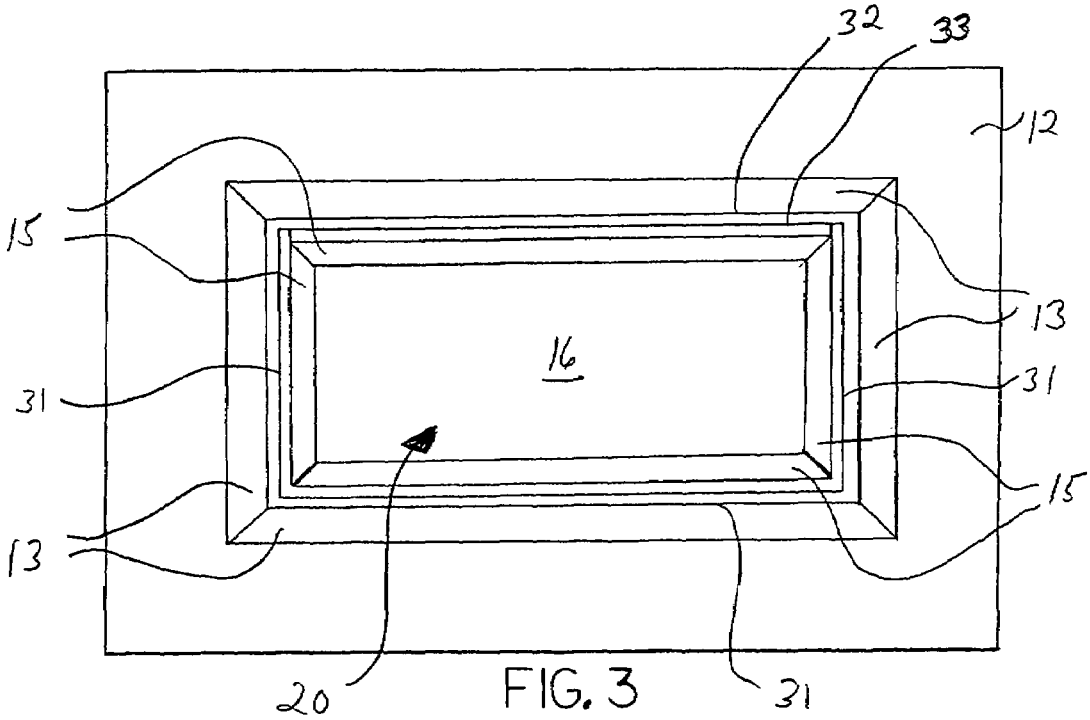
FIG. 3 is a front exterior view as in FIG. 2 showing the cover in place over the vent.
Figure 4:
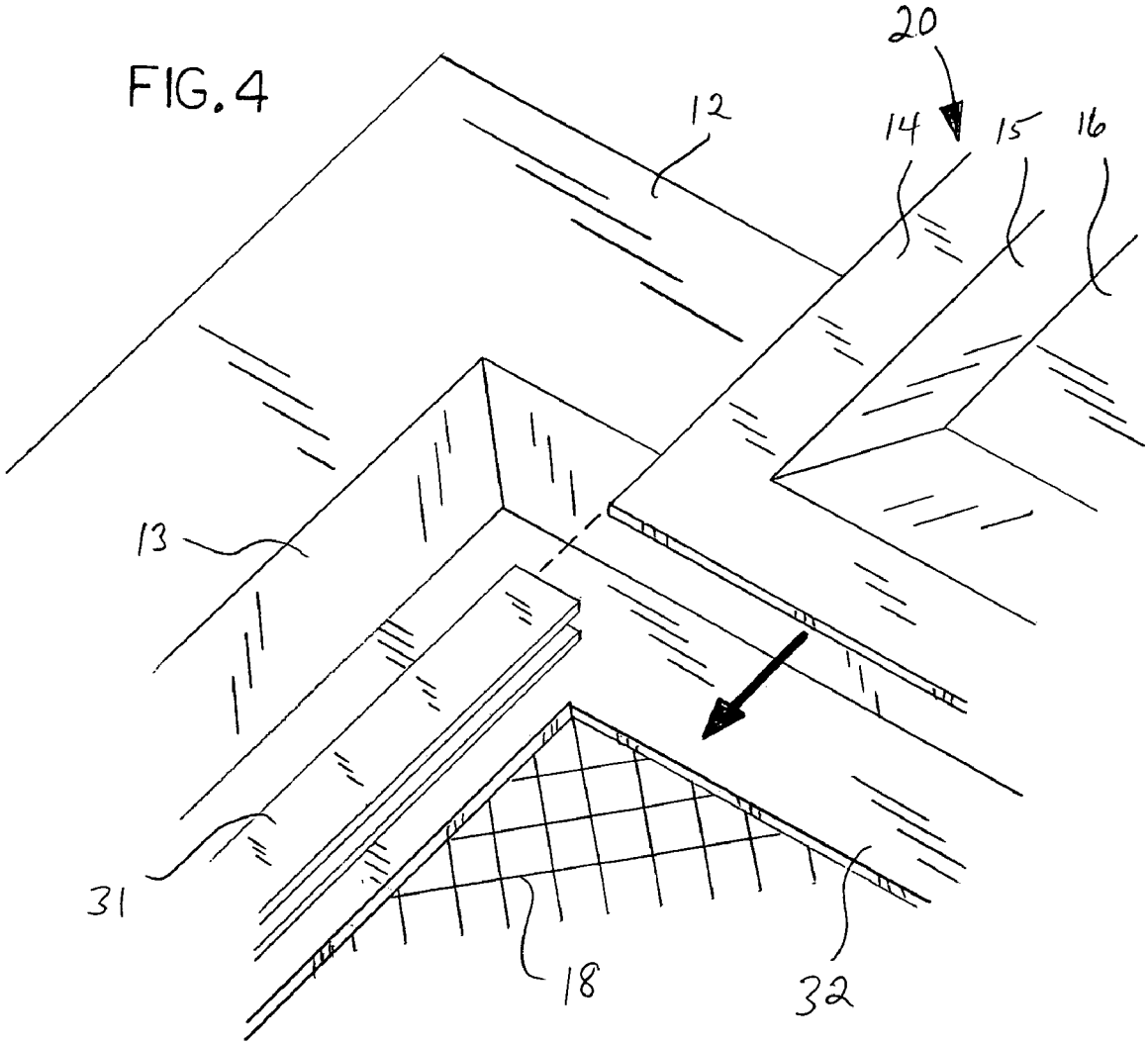
FIG. 4 is a perspective view of an upper corner of the cover track and lower corner of the cover immediately prior to insertion.
Figure 5:
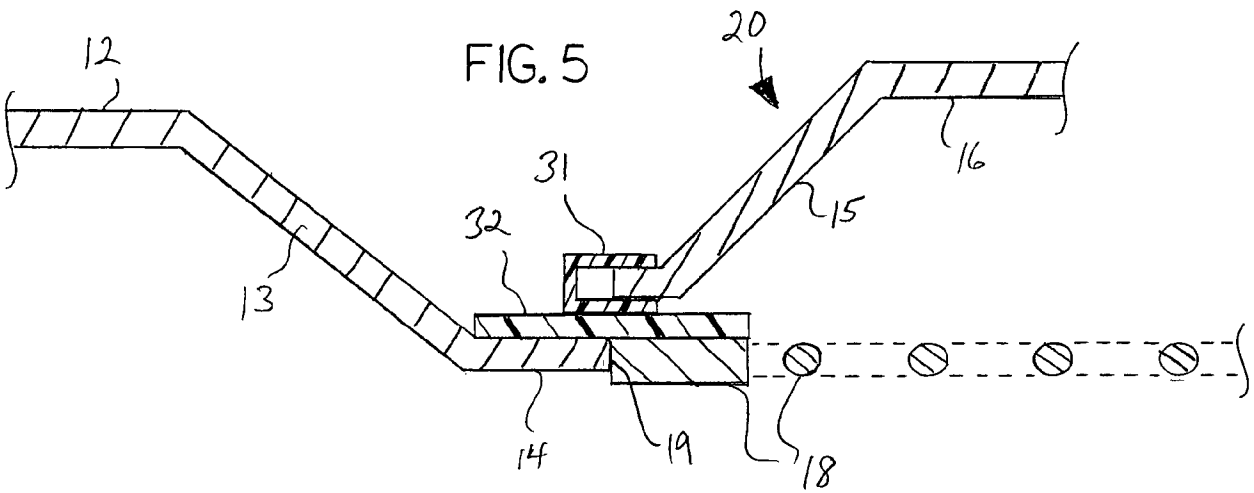
FIG. 5 is a partial cross-sectional view showing the cover in place over the vent.

Mounting means 30 for retaining the cover 20 on the exterior of the openings 19 are provided such that the covers 20 may be quickly and easily removed and replaced to cover or close the vents 18 or windows 17. Preferably, the mounting means 30 comprises a track 31 formed to be generally U-shaped in cross-section, as shown in FIGS. 4 and 5. The track 31 is disposed adjacent the bottom and sides of the opening 19 containing the vent 18 or window 17, and is sized so as to receive the side and bottom edges of the cover 20. Preferably, a trim member 33 of matching configuration and look to the track 31 is positioned along the upper edge of the cover 20, such that when the cover 20 is fully inserted into the track 31 the trim member 33 mates with the upper ends of the track 31 to form a continuous encircling perimeter about the cover 20, as seen in FIG. 3.

In a preferred embodiment, illustrated in the figures using a vent 18, the track 31 is mounted onto a frame member 32 that is affixed to the exterior side of the flat bottom 14 of the panel channel, such that it partially extends over the four sides of the opening 19. This enables the track 31 to be securely mounted directly over the edge of the opening 19, as shown in FIG. 5. Both the track 31 and the frame member 32 are preferably colored to match the color of the garage door 10. Alternatively to the construction as shown, the track 31 and frame member 32 may be formed as a unitary member through extrusion or similar manufacturing techniques.

In this manner, the vents 18 or the windows 17 can be easily and quickly exposed or covered as desired. To expose the vents 18 and windows 17, the cover 20 is removed by sliding it upward until its bottom edge clears the upper ends of track 31. To cover or conceal the vents 18 and windows 17, the cover 20 is slid down into the track 31 until its bottom edge rests against the lower portion of track 31 and the trim member 33 abuts the upper ends of the track 31. Where the cover 20 is colored to match the garage door 10, the covered vents 18 and windows 17 will present nearly the same visual appearance as the regular embossed raised panels 12, such that the covers 20 will not detract from the aesthetics of the structure. Alternatively, the covers 20, track 31 and trim member 33 can be of different color if a contrasting look is preferred.

In a preferred embodiment, the covers 20 are composed of the punch-outs that create the opening 19 for the vent 18 or window 17 in a typical garage door section 11 or panel 12. In manufacturing overhead garage doors 10, it is most common to first produce a solid section 11 with a relatively planar front or face, which are subsequently stamped or pressed to form the embossed raised panels 12. Where windows 17 or vents 18 are desired, a segment of the section 11 or panel 12 is removed in a cutting, stamping or punching operation to create an opening 19. The removed portions, known as punch-outs, are typically discarded as waste.

Figure 6:
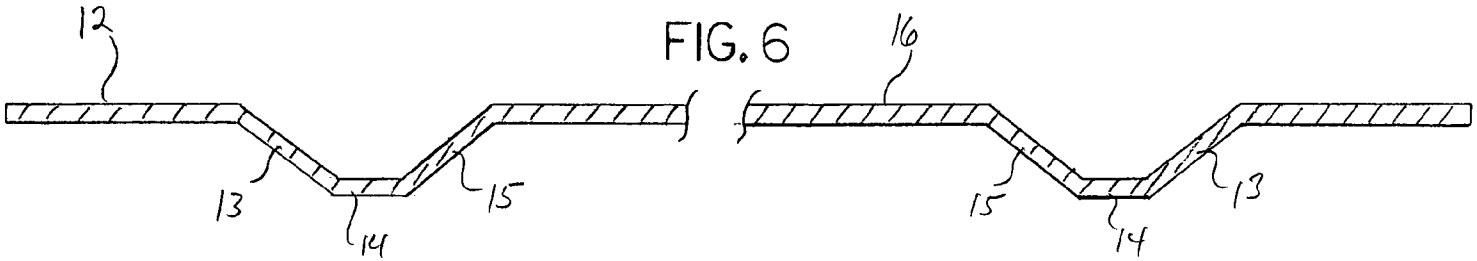
FIG. 6 is a cross-sectional view of a embossed raised panel as manufactured.
Figure 7:
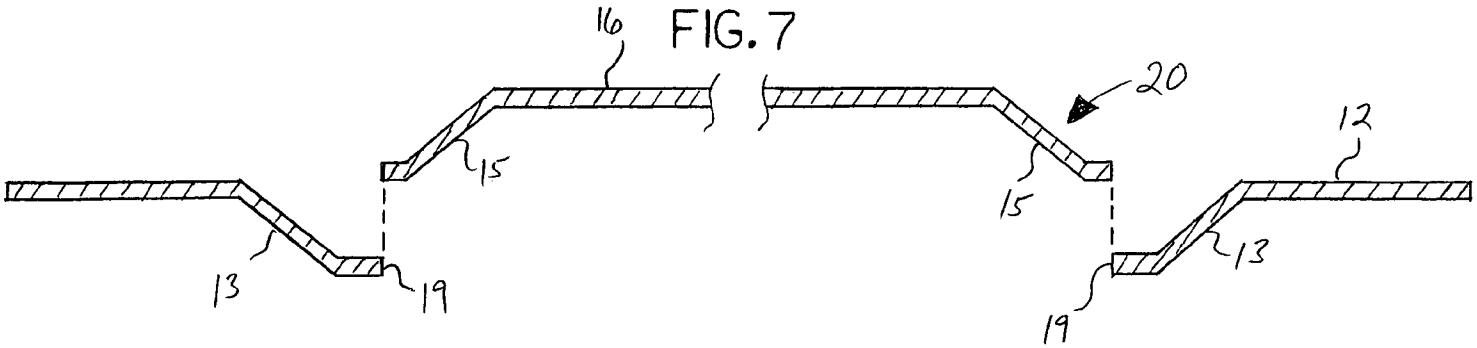
FIG. 7 is a cross-sectional view as in FIG. 6 showing the cover as removed from the door section.

In the invention, the covers 20 are formed of these punch-outs, such that the material is not wasted and extra material does not have to be used to make the covers 20. As shown in FIGS. 6 and 7, it is most preferable that an interior portion of the embossed raised panel 12 be punched out to form the cover 20, such that the opening 19 in the panel 12 is located on the flat bottom 19 of the panel channel. In this manner a flat surface is provided for mounting the frame member 32 and track 31, with the track 31 being positioned above the edges of the opening 19. The punch-out portion becomes the cover 20, such that as shown the cover 20 is formed of the planar face member 16, the sloping walls 15 and a portion of the flat bottom 14, thereby providing a flat perimeter to be received within the U-shaped track 31. With this construction, the color, texture and pattern of the cover 20 will match the color, texture and pattern of the garage door 10 exactly, and the only visible difference between a regular embossed raised panel 12 and a covered vent 18 or window 17 will be the presence of the frame 32, track 31 and trim member 33, which as previously discussed will be colored the same color as the garage door 10 so as to allow them to blend in visually.

It is understood that equivalents and substitutions for certain elements set forth above may be obvious to those skilled in the art, and therefore the true scope and definition of the invention is to be as set forth in the following claims.

I claim:

1. A method of manufacturing a garage door comprising a vent or window having a removable cover, said method comprising the steps of:

manufacturing a section for said garage door;

creating a cover for said vent or window by removing a portion of said section to create an opening to receive a vent or window;

affixing a vent or window to said section across said opening;

providing mounting means to removably retain said cover over said opening;

whereby said cover is inserted into said mounting means to conceal said vent or window, and whereby said cover is removed from said mounting means to expose said vent or window.

2. The method of claim 1, further comprising the step of:

providing embossed raised panels in said section;

wherein said step of creating said cover comprises removing a portion of said embossed raised panel.

3. The method of claim 2, wherein said step of providing embossed raised panels comprises creating a generally sloped outer wall, a generally flat bottom, a generally sloped inner wall and a generally planar face member; and wherein said step of creating said cover comprises removing said generally planar face member.

4. The method of claim 3, wherein said step of creating said cover further comprises removing said generally sloping inner wall.

5. The method of claim 1, wherein said step of providing mounting means to removably retain said cover comprises mounting a track adjacent the perimeter of said opening, said track being sized and positioned to receive said cover in sliding manner and to retain said cover in place over said vent or window.

6. The method of claim 5, further comprising the step of:

providing embossed raised panels in said section;

wherein said step of creating said cover comprises removing a portion of said embossed raised panel.

7. The method of claim 6, wherein said step of providing embossed raised panels comprises creating a generally sloped outer wall, a generally flat bottom, a generally sloped inner wall and a generally planar face member; and wherein said step of creating said cover comprises removing said generally planar face member.

8. The method of claim 7, wherein said step of creating said cover further comprises removing said generally sloping inner wall.

9. The method of claim 8, wherein said step of creating said cover further comprises removing a portion of said generally flat bottom.

10. The method of claim 9, further comprising the steps of:

mounting a frame member on said generally flat bottom extending around said opening; and wherein said step of mounting said track comprises mounting said track on said frame member.

11. The method of claim 10, further comprising the step of:

mounting a trim member onto said cover;

whereby said trim member abuts said track when said cover is retained by said track.

* * * * *